US009214126B2

(12) United States Patent
Choi

(10) Patent No.: US 9,214,126 B2
(45) Date of Patent: Dec. 15, 2015

(54) CIRCUIT FOR DRIVING LIQUID CRYSTAL DISPLAY DEVICE HAVING A PROGRAMMABLE POWER INTEGRATED CIRCUIT

(71) Applicant: LG Display Co., Ltd., Chicago, IL (US)

(72) Inventor: Jong Seong Choi, Nonsan-si (KR)

(73) Assignee: LG Display Co., Ltd., Seoul (KR)

( * ) Notice: Subject to any disclaimer, the term of this patent is extended or adjusted under 35 U.S.C. 154(b) by 238 days.

(21) Appl. No.: 13/653,739

(22) Filed: Oct. 17, 2012

(65) Prior Publication Data

US 2013/0127810 A1 May 23, 2013

(30) Foreign Application Priority Data

Nov. 22, 2011 (KR) ..... 10-2011-0122316

(51) Int. Cl.
*G09G 5/00* (2006.01)
*G09G 3/36* (2006.01)

(52) U.S. Cl.
CPC ..... *G09G 3/3688* (2013.01); *G09G 3/3685* (2013.01); *G09G 2310/027* (2013.01); *G09G 2320/0673* (2013.01)

(58) Field of Classification Search
CPC ..... G09G 3/3685
USPC ..... 345/211, 87
See application file for complete search history.

(56) References Cited

U.S. PATENT DOCUMENTS

2005/0200615 A1* 9/2005 Lin ..... 345/204
2006/0202929 A1* 9/2006 Baum et al. ..... 345/89
2008/0001897 A1* 1/2008 Lim ..... 345/98
2008/0291190 A1* 11/2008 Kim et al. ..... 345/211
2010/0156944 A1* 6/2010 Haupt et al. ..... 345/87

FOREIGN PATENT DOCUMENTS

CN 101162571 A 4/2008
CN 101169922 A 4/2008
CN 101256749 A 9/2008
KR 1020080084346 A 9/2008

OTHER PUBLICATIONS

Office Action and Search Report issued in Chinese Patent Application No. 201210397531.X. mailed Sep. 3, 2014, 12 pages.

* cited by examiner

*Primary Examiner* — Adam J Snyder
(74) *Attorney, Agent, or Firm* — Brinks Gilson & Lione

(57) ABSTRACT

A circuit for driving a liquid crystal display device includes a liquid crystal panel including a plurality of gate lines and data lines, a gate driver, a data driver, a memory for storing data necessary for operation of a timing controller and programmable power integrated circuit (PPIC) voltage setting data, the timing controller for reading and outputting the PPIC voltage setting data stored in the memory and reading the data necessary for operation of the timing controller stored in the memory and controlling the data driver and the gate driver, a PPIC for supplying a reference voltage, a gamma voltage and a common voltage to the data driver according to the voltage setting data supplied by the timing controller, and a power supply for receiving power from an external device and supplying power to each unit.

8 Claims, 9 Drawing Sheets

CIRCUIT FOR DRIVING LIQUID CRYSTAL DISPLAY DEVICE HAVING A PROGRAMMABLE POWER INTEGRATED CIRCUIT

This application claims the benefit of Korean Patent Application No. 10-2011-0122316 filed on Nov. 22, 2011, the content of which is incorporated herein by reference in its entirety.

BACKGROUND

1. Field of the Invention

The present disclosure relates to a liquid crystal display device and, more particularly, to a circuit for driving a liquid crystal display device, which is capable of reducing the number of writing processes performed by an operator and reducing a space of a programmable power integrated circuit (PPIC) so as to reduce costs, by storing PPIC voltage setting data in a memory, reading the voltage setting data stored in the memory by a timing controller when a voltage is applied, and transmitting the voltage setting data to the PPIC so as to set a voltage.

2. Discussion of the Related Art

Recently, among display devices, flat panel displays have been widely used as display devices due to their excellent image quality, light weight, slimness and low power consumption. As the flat panel display, a Liquid Crystal Display (LCD) device, an Organic Light Emitting Diode (OLED) display device, etc. have been commercially used.

An LCD device displays an image using electrical and optical characteristics of liquid crystal. Liquid crystal has an anisotropic property in which a refractive index and a dielectric constant are changed according to major-axis direction and minor-axis direction of molecular and may easily adjust molecule arrangement and optical characteristics. The LCD device using liquid crystal displays an image by changing an arrangement direction of liquid crystal molecules according to the magnitude of an electric field so as to adjust transmittance of light passing through a polarization plate.

The general LCD device will now be described with reference to the accompanying drawings.

FIG. 1 is a diagram showing the configuration of a general LCD device, FIG. 2 is a diagram showing the configuration of a general EEPROM, and FIG. 3 is a diagram showing the configuration of a general programmable power IC (PPIC).

As shown in FIG. 1, the general LCD device includes a liquid crystal panel 2 including a plurality of gate lines GL1 to GLn arranged in one direction at a predetermined interval, a plurality of data lines DL1 to DLm arranged in a direction perpendicular to the plurality of gate lines GL1 to GLn to define pixel regions, thin film transistors (TFTs) respectively formed in the pixel regions and liquid crystal capacitors Clc connected to the TFTs; a gate driver 6 for driving the gate lines GL1 to GLn of the liquid crystal panel 2; a data driver 4 for driving the data lines DL1 to DLm of the liquid crystal panel 2; a timing controller 8 for aligning image data RGB received from an external system 1, supplying the aligned image data RGB to the data driver 4, and controlling the data driver 4; an Electrically Erasable Programmable Read-Only Memory (EEPROM) 9 for storing data necessary for operation of the timing controller 8; a power supply 10 for receiving power from the external system 1 and supplying power to each unit; and a programmable power IC (PPIC) 11 for storing voltage setting data for supplying a reference voltage Vref and a common voltage Vcom to the data driver 4 according to model.

The liquid crystal capacitor Clc includes a pixel electrode connected to the TFT and a common electrode provided on the pixel electrode with liquid crystal interposed therebetween. The TFT supplies an image signal from each of the data lines DL1 to DLm to the pixel electrode in response to a scan pulse from each of the gate lines GL1 to GLn. The liquid crystal capacitor Clc charges a difference voltage between the image signal supplied to the pixel electrode and the common voltage and changes arrangement of liquid crystal molecules according to the difference voltage to control light transmittance, thereby implementing gray scale. At this time, a storage capacitor Cst may be formed by stacking the pixel electrode and a storage line with an insulating film interposed therebetween.

The gate driver 6 sequentially drives the gate lines GL1 to GLn according to a gate control signal (GCS) from the timing controller 8. More specifically, the gate driver 4 sequentially supplies a scan pulse of a gate high voltage (VGH) level to each of the gate lines GL1 to GLn using a gate start pulse (GSP), a gate shift clock (GSC) and a gate output enable (GOE) signal, all of which are gate control signals (GCS). In the remaining period in which the scan pulse is not supplied, a gate low voltage is supplied.

The data driver 4 receives the aligned data from the timing controller 8, receives the voltage from the PPIC and converts the voltage into an analog voltage, that is, an image signal, using a data control signal (DCS) from the timing controller 8, such as a source start pulse (SSP), a source shift clock (SSC), a source output enable (SOE) signal and an inversion (Pol) signal.

The timing controller 8 controls the data driver 4 and the gate driver 6 according to external image data RGB and a plurality of synchronization signals DCLK, Hsync, Vsync and DE. More specifically, the timing controller 8 aligns the external image data RGB according to driving of the liquid crystal panel 2 and supplies the aligned image data to the data driver 4. The timing controller generates the gate control signal (GCS) and the data control signal (DCS) using at least one of the external synchronization signals, that is, a dot clock DCLK, a data enable signal DE, horizontal and vertical synchronization signals Hsync and Vsync, and supplies the same to the gate driver 6 and the data driver 4.

The timing controller 8 for performing the above operation uses the EEPROM 9 located outside a chip in order to store target register configuration data for controlling the above operation.

That is, data corresponding to an LCD device of each model is written in the EEPROM 9 shown in FIG. 2 and the timing controller 8 reads and uses necessary data from the EEPROM 9. A separate memory for storing the voltage setting data is included in the PPIC 11 shown in FIG. 3 and the PPIC 11 outputs a voltage according to the voltage setting data stored in the internal memory regardless of control of the timing controller 8 when power is applied. That is, a logic for physical communication and signal processing is not present between the timing controller 8 and the PPIC 11.

However, the conventional circuit for driving the LCD device has the following problems.

That is, the EEPROM has a data storage function and a function for exchanging data through communication with the timing controller. The PPIC has a communication function for voltage programming and a data storage function. However, since data is separately written, a data writing process is performed two times. Thus, much processing time is consumed. In addition, since spaces for the EEPROM and the PPIC should be secured, costs are increased.

BRIEF SUMMARY

A circuit for driving a liquid crystal display (LCD) device includes a liquid crystal panel including a plurality of gate lines and a plurality of data lines, a gate driver that drives the gate lines of the liquid crystal panel, a data driver that drives the data lines of the liquid crystal panel, a Memory that stores data necessary for operation of a timing controller and programmable power integrated circuit (PPIC) voltage setting data, the timing controller reading and outputting the PPIC voltage setting data stored in the memory and reading the data necessary for operation of the timing controller stored in the memory and controlling the data driver and the gate driver, a PPIC that supplies a reference voltage, a gamma voltage and a common voltage to the data driver according to the voltage setting data supplied by the timing controller, and a power supply that receives power from an external device and supplying power to each unit.

A method for driving a liquid crystal display (LCD) device including a memory storing data necessary for operation of a timing controller at addresses aa to bb and programmable power integrated circuit (PPIC) voltage setting data at addresses xx to yy, comprising: reading the voltage setting data of the address xx and writing the voltage setting data in a programmable power integrated circuit PPIC, when power is turned on; increasing the address one by one, and repeatedly reading and writing the voltage setting data of the increased address from the memory in the PPIC up to a last address yy; supplying a reference voltage Vref and a common voltage Vcom from the PPIC to a data driver according to the voltage setting data; and reading the data corresponding to the addresses aa to bb of the memory and controlling gate and data drivers.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE DRAWINGS AND THE PRESENTLY PREFERRED EMBODIMENTS

A circuit for driving an LCD device according to the present invention having the above-described features will be described in detail.

Figure 1:
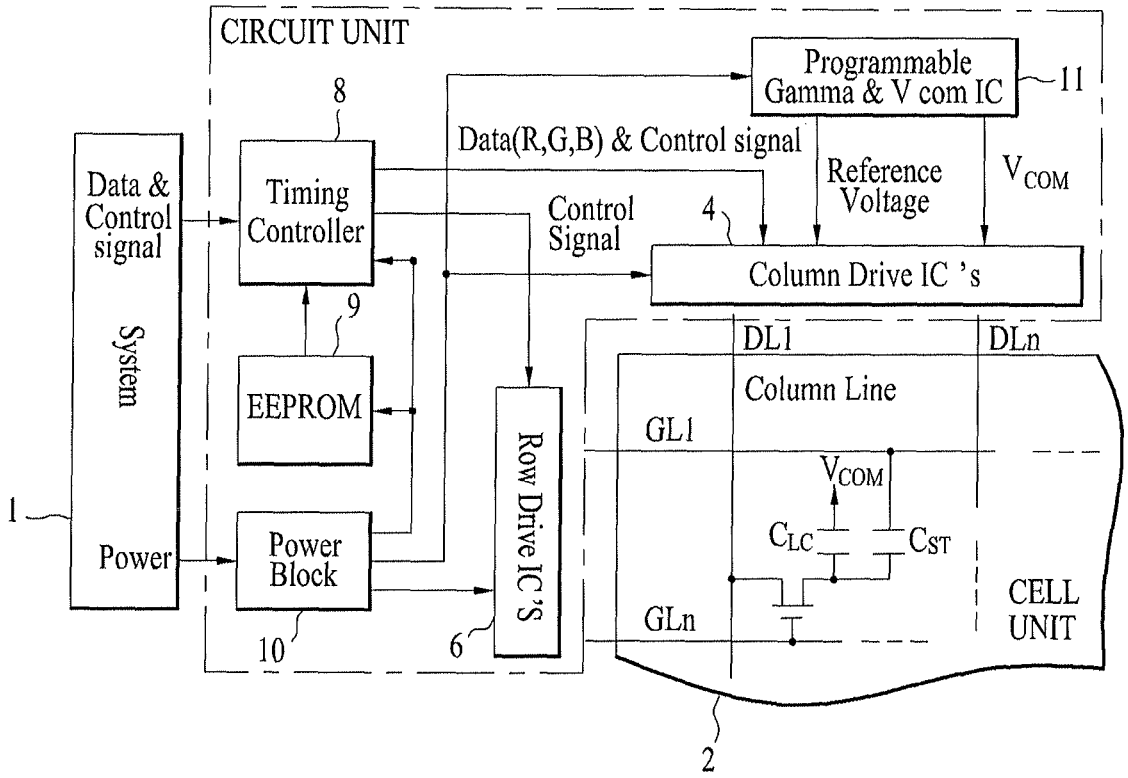
FIG. 1 Prior art
FIG. 1 is a diagram showing a general liquid crystal display (LCD) device.
Figure 2:
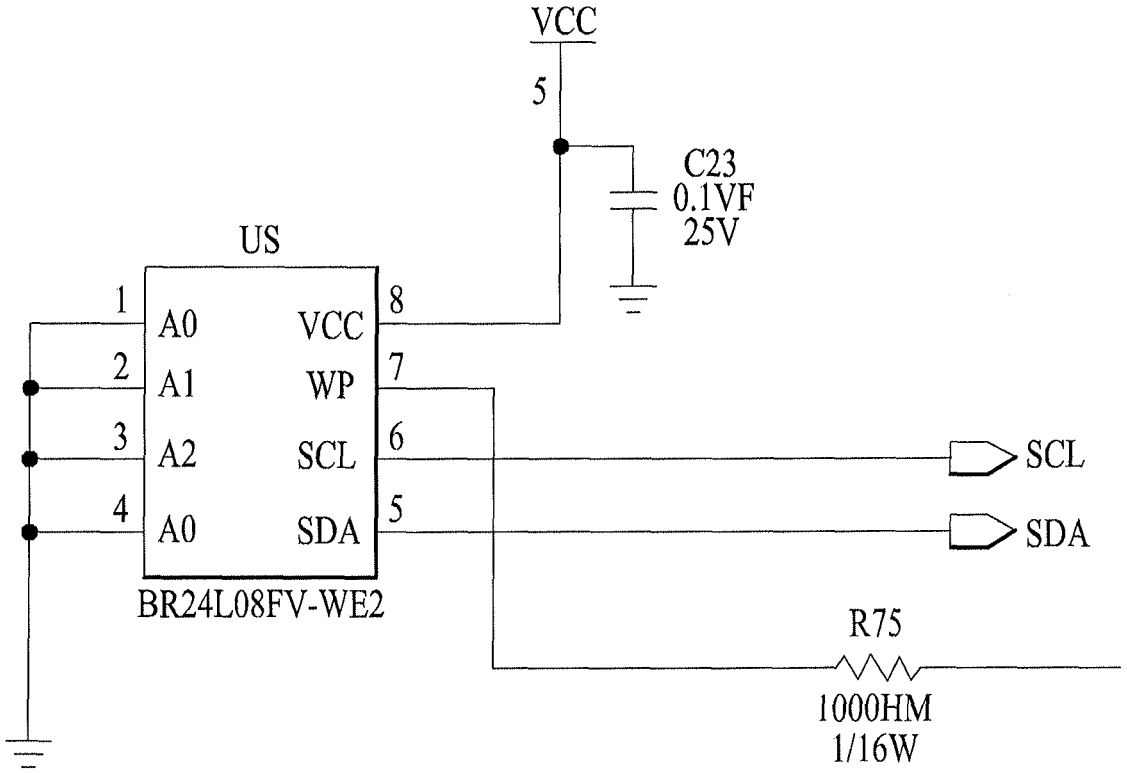
FIG. 2 Related art
FIG. 2 is a diagram showing the configuration of a general EEPROM.
Figure 3:
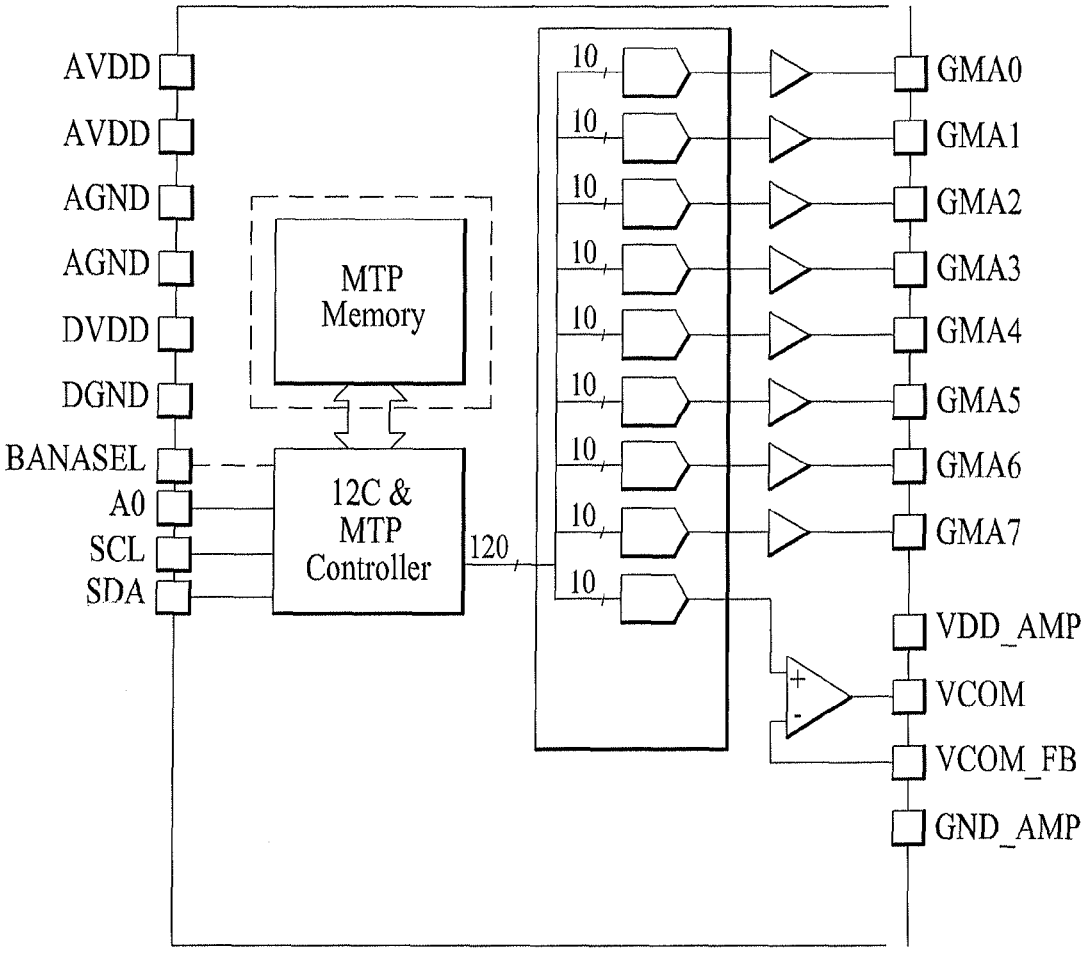
FIG. 3 Related art
FIG. 3 is a diagram showing the configuration of a general programmable power integrated circuit (PPIC)
Figure 4:
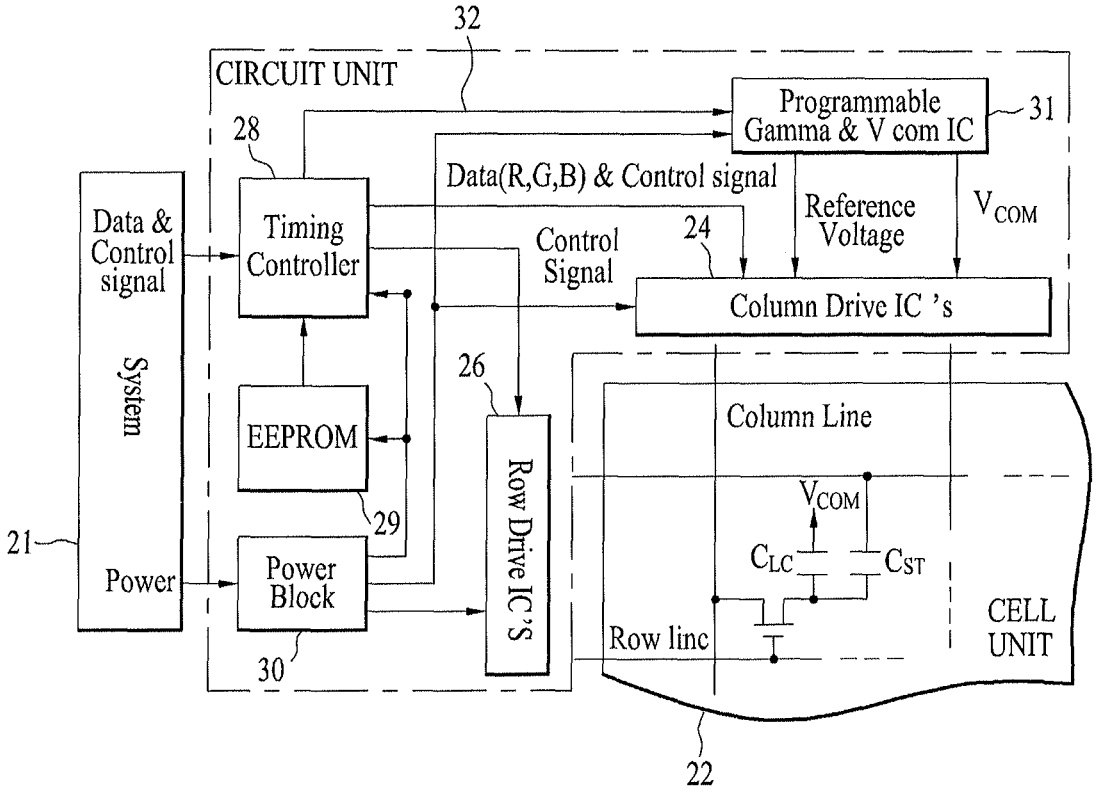
FIG. 4 is a diagram showing the configuration of a circuit for driving an LCD device according to a first embodiment of the present invention.
Figure 5:
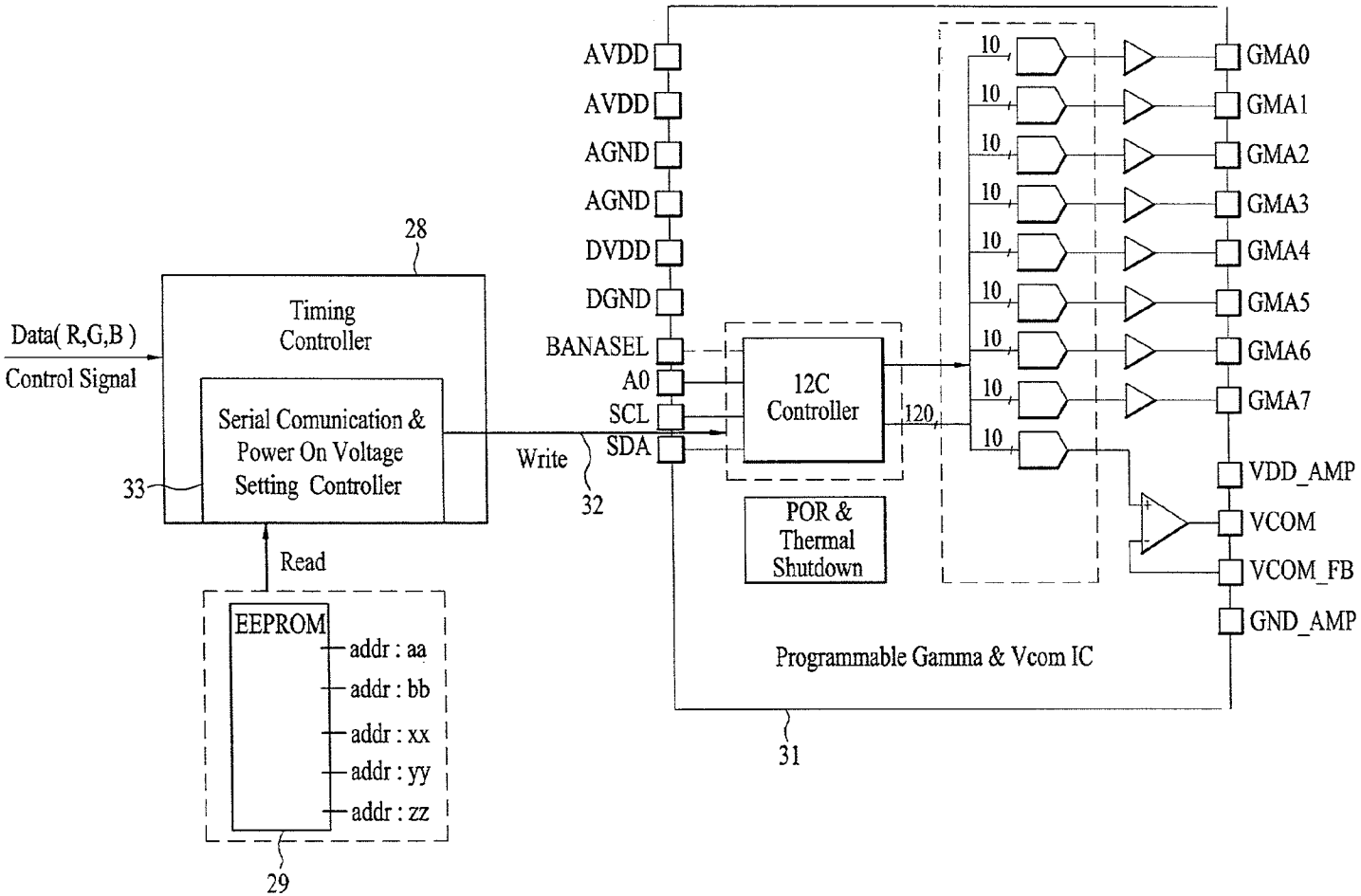
FIG. 5 is a diagram showing a timing controller, an EEPROM and a PPIC according to a first embodiment of the present invention.

FIG. 4 is a diagram showing the configuration of a circuit for driving an LCD device according to a first embodiment of the present invention, and FIG. 5 is a diagram showing a timing controller, an EEPROM and a PPIC according to a first embodiment of the present invention.

The configuration of the circuit for driving the LCD device according to the first embodiment of the present invention is shown in FIG. 4 and is similar to the conventional circuit for driving the LCD device except that a logic for physical communication and signal processing is formed between a timing controller and a programmable power integrated circuit (PPIC) and voltage setting data is not written in the PPIC but is written in an EEPROM.

That is, as shown in FIG. 4, the circuit for driving the LCD device according to the first embodiment of the present invention includes a liquid crystal panel 22 including a plurality of gate lines GL1 to GLn arranged in one direction at a predetermined interval, a plurality of data lines DL1 to DLm arranged in a direction perpendicular to the plurality of gate lines GL1 to GLn to define pixel regions, thin film transistors (TFTs) respectively formed in the pixel regions and liquid crystal capacitors Clc connected to the TFTs; a gate driver 26 for driving the gate lines GL1 to GLn of the liquid crystal panel 22; a data driver 24 for driving the data lines DL1 to DLm of the liquid crystal panel 22; a timing controller 28 for aligning image data RGB received from an external system 21, supplying the aligned image data RGB to the data driver 4, and controlling the data driver 24 and the gate driver; an Electrically Erasable Programmable Read-Only Memory (EEPROM) 29 for storing data necessary for operation of the timing controller 28 and PPIC voltage setting data; a power supply 30 for receiving power from the external system 21 and supplying power to each unit; and a PPIC 31 for supplying a reference voltage, a gamma voltage and a common voltage (Vcom) to the data driver 24 according to the voltage setting data supplied by the timing controller 28.

A logic 32 for physical communication and signal processing is formed between the timing controller 28 and the PPIC 31.

The liquid crystal capacitor Clc includes a pixel electrode connected to the TFT and a common electrode provided on the pixel electrode with liquid crystal interposed therebetween. The TFT supplies an image signal from each of the data lines DL1 to DLm to the pixel electrode in response to a scan pulse from each of the gate lines GL1 to GLn. The liquid crystal capacitor Clc charges a difference voltage between the image signal supplied to the pixel electrode and the common voltage and changes arrangement of liquid crystal molecules according to the difference voltage to control light transmittance, thereby implementing gray scale. At this time, a storage capacitor Cst may be formed by stacking the pixel electrode and a storage line with an insulating film interposed therebetween.

The gate driver 26 sequentially drives the gate lines GL1 to GLn according to a gate control signal (GCS) from the timing controller 28. More specifically, the gate driver 24 sequentially supplies a scan pulse of a gate high voltage (VGH) level to each of the gate lines GL1 to GLn using a gate start pulse (GSP), a gate shift clock (GSC) and a gate output enable (GOE) signal, all of which are gate control signals (GCS). In the remaining period in which the scan pulse is not supplied, a gate low voltage is supplied.

The data driver 24 receives the aligned data from the timing controller 28, receives the voltage from the PPIC and converts the voltage into an analog voltage, that is, an image signal, using a data control signal (DCS) from the timing controller 8, such as a source start pulse (SSP), a source shift clock (SSC), a source output enable (SOE) signal and an inversion (Pol) signal.

The timing controller 28 controls the data driver 24 and the gate driver 26 according to external image data RGB and a plurality of synchronization signals DCLK, Hsync, Vsync and DE. More specifically, the timing controller 28 aligns the external image data RGB according to driving of the liquid crystal panel 22 and supplies the aligned image data to the data driver 24. The timing controller generates the gate control signal (GCS) and the data control signal (DCS) using at least one of the external synchronization signals, that is, a dot clock DCLK, a data enable signal DE, horizontal and vertical synchronization signals Hsync and Vsync, and supplies the same to the gate driver 26 and the data driver 24.

The timing controller 28 for performing the above operation uses the EEPROM 29 located outside a chip in order to store data for controlling the above operation and PPIC voltage setting data.

Accordingly, the timing controller 28 reads and supplies the PPIC voltage setting data stored in the EEPROM 29 to the PPIC 31 through the logic 32.

The timing controller 28 includes a serial communication and power on voltage setting controller 33 as shown in FIG. 5. The serial communication and power on voltage setting controller 33 serves to read the PPIC voltage setting data stored in the EEPROM 29 and to supply the read PPIC voltage setting data to the PPIC 31 through the logic 32.

Generally, since the timing controller uses serial communication to read data from the EEPROM, the logic of the serial communication and power on voltage setting controller 33 is not substantially increased.

In FIG. 5, assume that addresses aa to bb of the EEPROM 29 are data storage spaces used in the related art, addresses xx to yy are voltage setting data storage spaces for PPIC, data of the addresses aa to bb are used in the timing controller 28 as in the related art and data of the additional addresses xx to yy is read by the timing controller and is written in the PPIC 31.

Accordingly, the PPIC 31 according to the present invention does not include a memory for storing the voltage setting data. Since the PPIC 31 does not have the voltage setting data, the timing controller 28 serves to check a power on condition to enable the PPIC 31 to set a voltage, when power is turned on. The PPIC 32 serves to block output of a gamma voltage, a reference voltage and a common voltage for outputting an image on the screen of the LCD device before the timing controller 28 supplies the voltage setting data, in order to prevent the LCD device from being damaged by being supplied a voltage which is not suitable for requirements of the LCD device.

The power supply 30 and the PPIC 31 may be combined into one chip.

Figure 6:
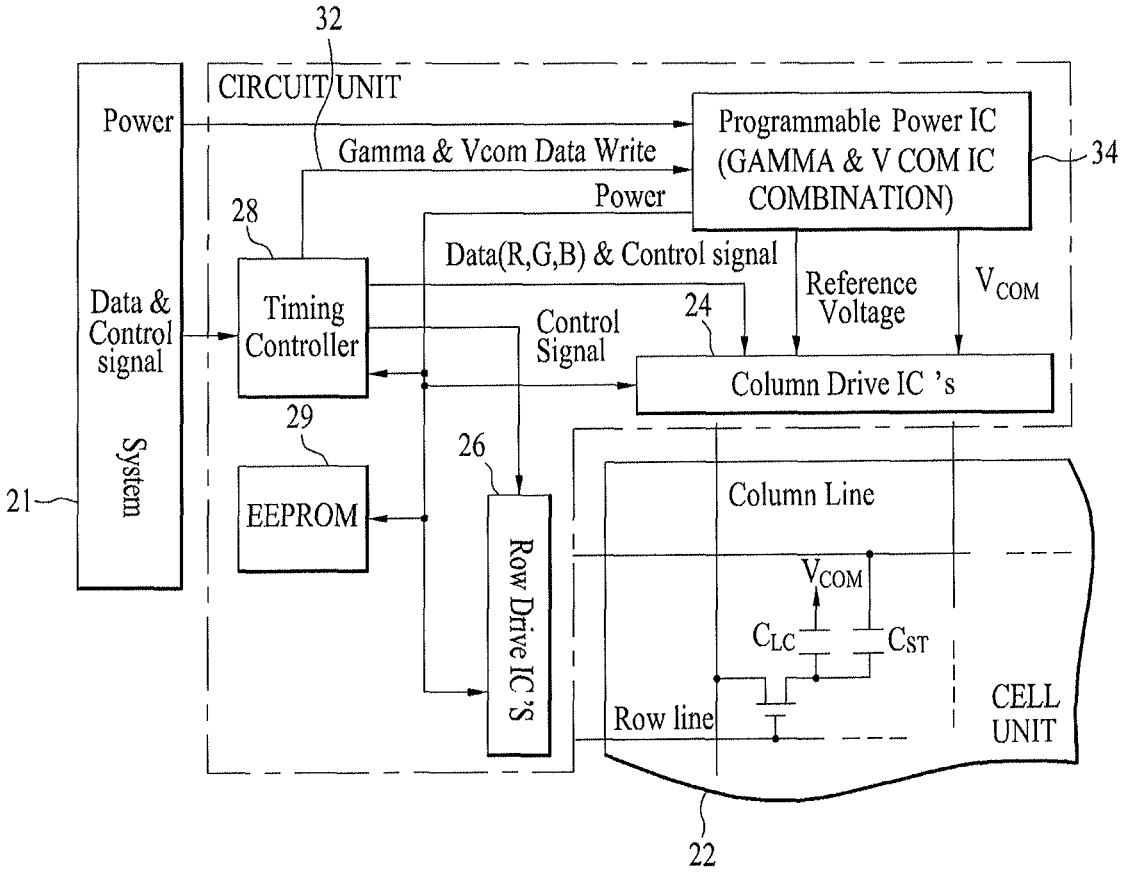
FIG. 6 is a diagram showing a circuit for driving an LCD according to a second embodiment of the present invention.

FIG. 6 is a diagram showing the configuration of a circuit for driving an LCD device according to a second embodiment of the present invention.

The circuit for driving the LCD device according to the second embodiment of the present invention is similar to the first embodiment of the present invention except that the power supply 30 and the PPIC 31 are combined into one chip so as to implement a combined IC 34.

A method of writing the voltage setting data of the PPIC in the EEPROM in the circuit for driving the LCD device of the present invention having the above configuration will now be described.

Figure 7:
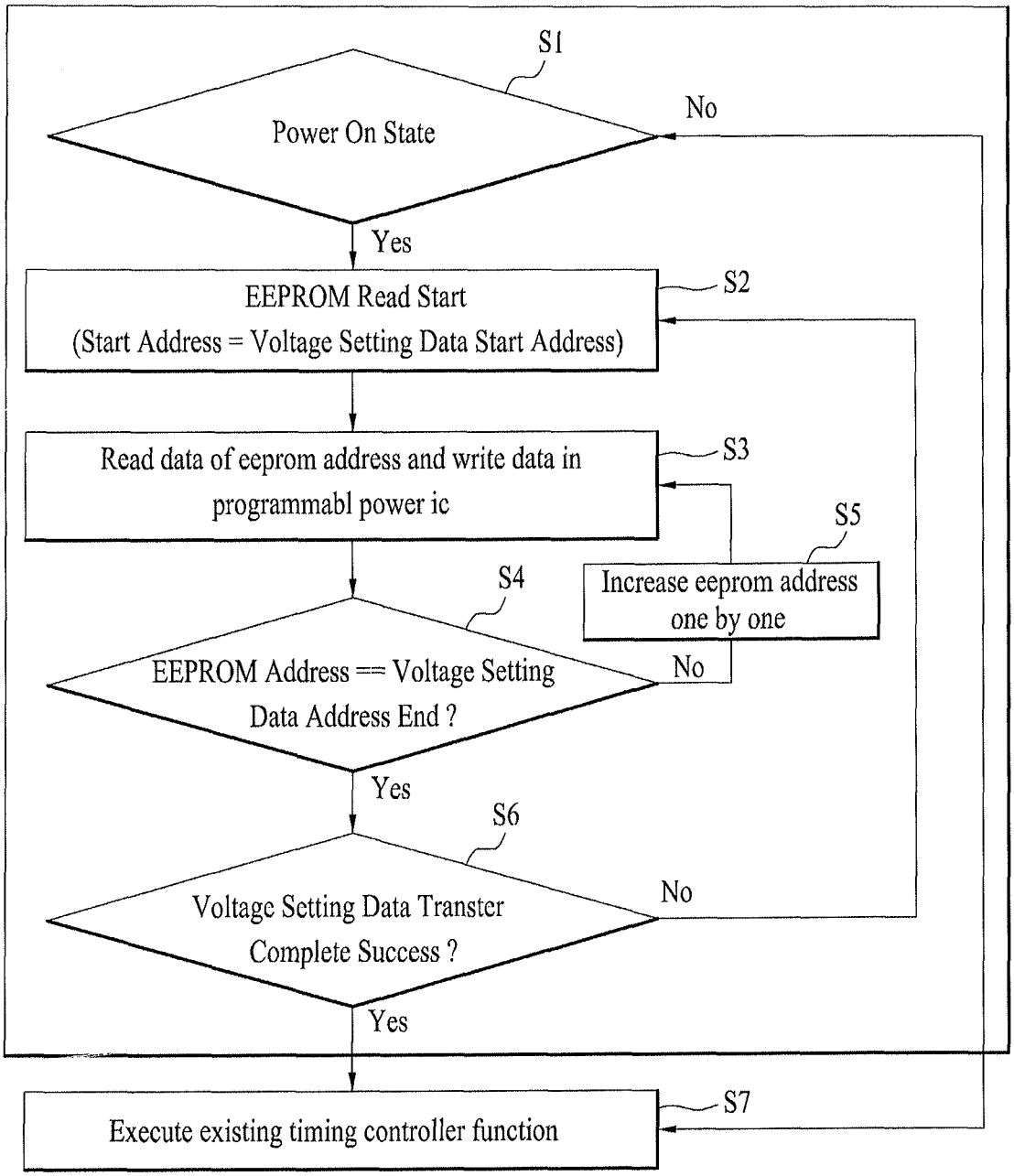
FIG. 7 is a flowchart illustrating a first embodiment of a serial communication and power on voltage setting controller in a timing controller according to the present invention.

FIG. 7 is a flowchart illustrating a first embodiment of a serial communication and power on voltage setting controller 33 in a timing controller according to the present invention.

The serial communication and power on voltage setting controller 33 of the timing controller 28 reads, from the EEPROM 29, data corresponding to the address xx, at which the voltage setting data starts to be stored, among addresses of the EEPROM 29 and writes the voltage setting data in the PPIC 31 (S2 and S3), when power is turned on (S1).

The address is increased one by one (S4) and the process of reading the voltage setting data of the address from the EEPROM 29 and writing the voltage setting data in the PPIC 31 is repeatedly performed up to a last address yy (S2 to S5) such that the PPIC 31 supplies the reference voltage Vref and the common voltage Vcom to the data driver 24 according to voltage setting data supplied by the timing controller 28.

If the above process is completed (S6), the timing controller 28 reads the data corresponding to the addresses aa to bb of the EEPROM 29 and controls the gate driver 26 and the data driver 24 as described above (S7).

Although the voltage setting data stored at the addresses is read one by one and sequentially written in the PPIC 31 in FIG. 7, the present invention is not limited thereto.

Figure 8:
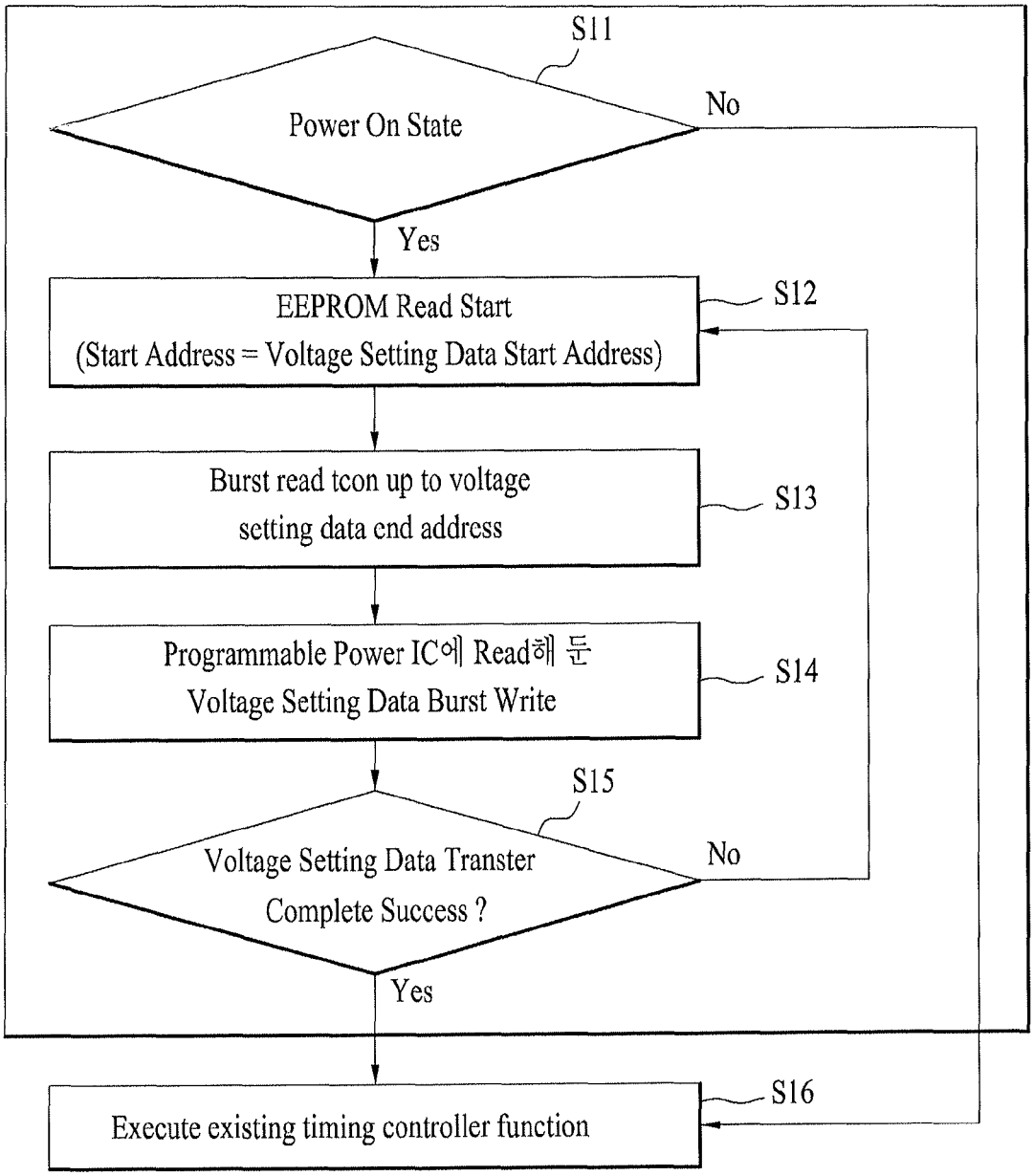
FIG. 8 is a flowchart illustrating a second embodiment of a serial communication and power on voltage setting controller in a timing controller according to the present invention.

FIG. 8 is a flowchart illustrating a second embodiment of a serial communication and power on voltage setting controller 33 in a timing controller according to the present invention.

The serial communication and power on voltage setting controller 33 of the timing controller 28 reads, from the EEPROM 29, data corresponding to the addresses xx to yy, at which the voltage setting data is stored, among addresses of the EEPROM 29 (S12 and S13), when power is turned on (S11).

The serial communication and power on voltage setting controller 33 writes the read voltage setting data in the PPIC 31 (S14) and the PPIC 31 supplies the reference voltage Vref and the common voltage Vcom to the data driver 24 according to voltage setting data supplied by the timing controller 28 (S15).

If the above process is completed (S15), the timing controller 28 reads the data corresponding to the addresses aa to bb of the EEPROM 29 and controls the gate driver 26 and the data driver 24 as described above (S16).

Operation of the PPIC 31 will now be described.

Figure 9:
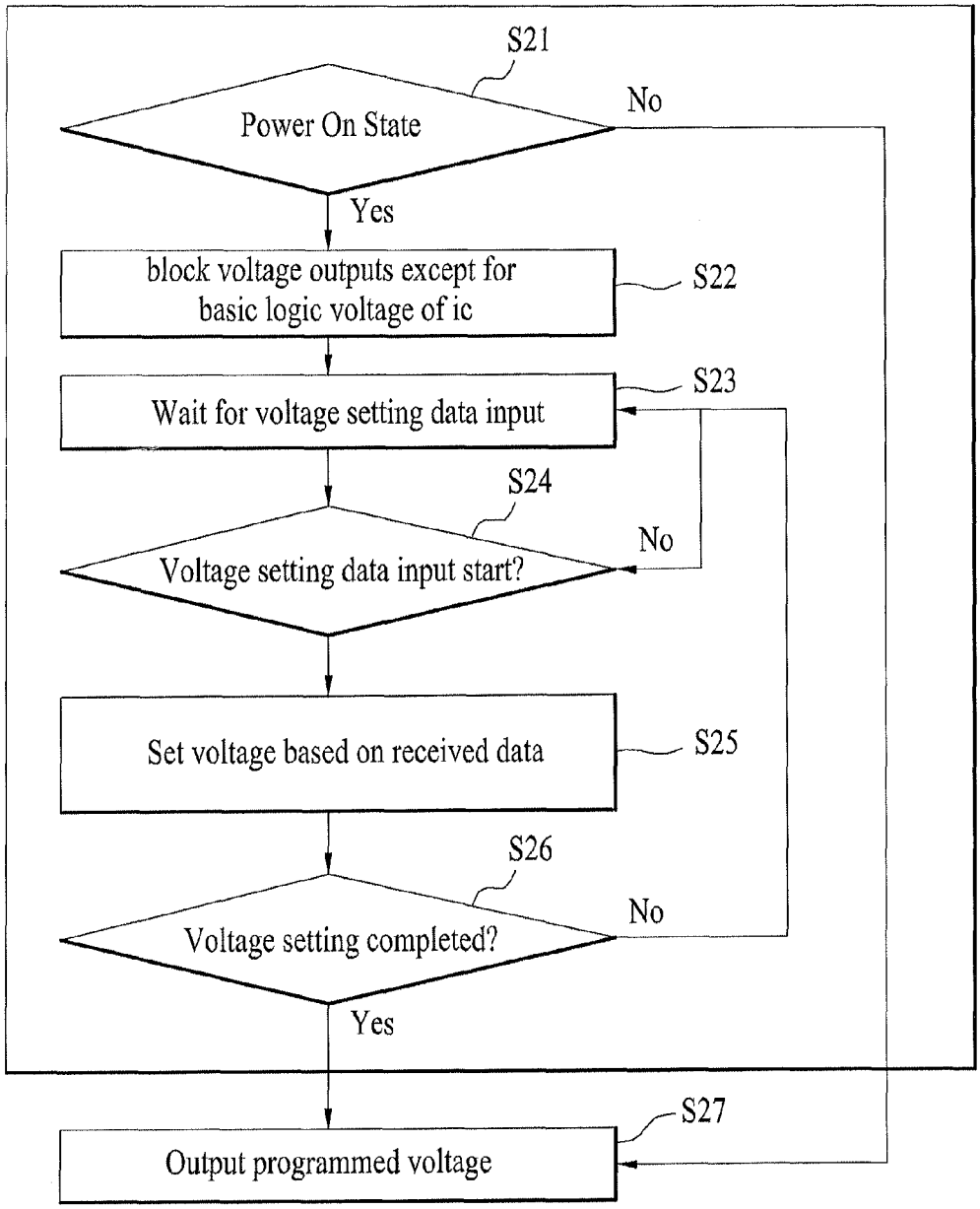
FIG. 9 is a flowchart illustrating operation of a PPIC according to the present invention.

FIG. 9 is a flowchart illustrating operation of a PPIC according to the present invention.

When power is turned on (S21), the PPIC 31 blocks all voltage outputs except for a basic logic voltage of the IC and waits for a voltage setting data input (S22 to S23). If the voltage setting data is received from the timing controller 28, the voltage is set based on the received voltage setting data (S25).

If voltage setting is completed (S25), the programmed voltage is output (S26).

The circuit for driving the LCD device according to the present invention having the above-described features has the following effects.

First, by forming a logic for physical communication and signal processing between a timing controller and a PPIC, storing PPIC voltage setting data in an EEPROM, reading a voltage setting data stored in the EEPROM by the timing controller when a voltage is applied, and transmitting the voltage setting data to the PPIC so as to set a voltage, it is possible to reduce the number of writing processes of an operator and reduce a tact time and wage of an operator.

Second, by reducing a voltage setting data storage space of a PPIC, it is possible to reduce costs.

Third, since a power supply and a PPIC are combined into a single chip, it is possible to improve management and engineering efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A circuit for driving a liquid crystal display (LCD) device, comprising:

a liquid crystal panel including a plurality of gate lines and a plurality of data lines;

a gate driver that drives the gate lines of the liquid crystal panel;

a data driver that drives the data lines of the liquid crystal panel;

a Memory that stores data necessary for operation of a timing controller and programmable power integrated circuit (PPIC) voltage setting data;

the timing controller reading and outputting the PPIC voltage setting data stored in the Memory, and reading the data necessary for operation of the timing controller stored in the Memory and controlling the data driver and the gate driver;

a programmable power integrated circuit (PPIC) that receives the PPIC voltage setting data from the timing controller, and supplies a reference voltage, a gamma voltage and a common voltage to the data driver according to the voltage setting data supplied by the timing controller; and a power supply that receives power from an external device and supplying power to each unit, wherein the timing controller includes a serial communication and power on voltage setting controller serving to enable the PPIC when power is turned on to start reading the PPIC voltage setting data from the memory and to supply the read PPIC voltage setting data to the PPIC through the logic so that the programmable power integrated circuit (PPIC) does not require a memory storing the PPIC voltage setting data.

2. The circuit according to claim 1, further comprising a logic configured to provide physical communication and signal processing between the timing controller and the PPIC.

3. The circuit according to claim 1, wherein the power supply and the PPIC are combined into a single chip.

4. The circuit according to claim 1, wherein the Memory stores the data necessary for operation of the timing controller at addresses aa to bb and stores the PPIC voltage setting data at addresses xx to yy, and wherein the timing controller reads the data corresponding to the address aa to bb of the Memory after the timing controller completes writing the PPIC voltage setting data in the PPIC.

5. A method for driving a liquid crystal display (LCD) device including a memory storing data necessary for operation of a timing controller at addresses aa to bb and programmable power integrated circuit (PPIC) voltage setting data at addresses xx to yy, comprising:

enabling the PPIC by the timing controller when power is turned on;

reading the voltage setting data of the address xx and writing the voltage setting data in a programmable power integrated circuit PPIC;

increasing the address one by one, and repeatedly reading and writing the voltage setting data of the increased address from the memory in the PPIC up to a last address yy, so that the programmable power integrated circuit PPIC does not require a memory storing the PPIC voltage setting data;

supplying a reference voltage Vref and a common voltage Vcom from the PPIC to a data driver according to the voltage setting data; and reading the data corresponding to the addresses aa to bb of the memory and controlling gate and data drivers.

6. The method according to claim 5, wherein the PPIC blocks all voltage outputs except for a basic logic voltage of IC and waits for the voltage setting data, when power is turned on, and supplies the reference voltage Vref and the common voltage Vcom to the data driver according to the voltage setting data.

7. A method for driving a liquid crystal display (LCD) device including a memory storing data necessary for operation of a timing controller at addresses aa to bb and programmable power integrated circuit (PPIC) voltage setting data at addresses xx to yy, comprising:

enabling the PPIC by the timing controller when power is turned on;

reading the voltage setting data corresponding to the addresses xx to yy, when power is turned on;

writing the read voltage setting data in a programmable power integrated circuit (PPIC), so that the programmable power integrated circuit (PPIC) does not require a memory storing the PPIC voltage setting data;

supplying a reference voltage Vref and a common voltage Vcom from the PPIC to a data driver according to the voltage setting data;

reading the data corresponding to the addresses aa to bb of the memory and controlling a gate driver and the data driver.

8. The method according to claim 7, wherein the PPIC blocks all voltage outputs except for a basic logic voltage of IC and waits for the voltage setting data, when power is turned on, and supplies the reference voltage Vref and the common voltage Vcom to the data driver according to the voltage setting data.

* * * * *